United States Patent [19]

Firey

[11] Patent Number: 4,692,171

[45] Date of Patent: Sep. 8, 1987

[54] SOLID WITH GAS REACTOR PLANT

[76] Inventor: Joseph C. Firey, P.O. Box 15514, Seattle, Wash. 98115-0514

[21] Appl. No.: 791,798

[22] Filed: Oct. 28, 1985

[51] Int. Cl.[4] ..... C10J 3/02; C10J 3/20

[52] U.S. Cl. ..... 48/61; 48/86 R; 48/DIG. 6; 60/39.12; 60/39.17; 123/1 R; 123/23; 123/64; 422/111; 422/116; 422/235

[58] Field of Search ..... 48/61, 63, 64, 76, 86 R, 48/197 R, 203, 206, DIG. 6; 60/39.04, 39.12, 39.17; 422/110, 111, 116, 234, 235; 55/18; 123/1 R, 3, 23, 24, 64

[56] References Cited

U.S. PATENT DOCUMENTS

| | | | |
|---|---|---|---|
| 4,085,578 | 4/1978 | Kydd | 48/63 |
| 4,310,490 | 1/1982 | Rusran et al. | 422/235 |
| 4,323,370 | 4/1982 | Leitgeb | 55/18 |
| 4,568,361 | 2/1986 | Firey | 48/197 R |
| 4,584,970 | 4/1986 | Firey | 123/23 |

*Primary Examiner*—David L. Lacey

[57] ABSTRACT

A reactor plant is described comprising separate compressor and expander, and several reaction chambers. Solid reactant within each said reaction chamber is alternately compressed with reactant gas from the compressor and subsequently the consequently reacted gases are expanded through the expander. Rapid gas with solid reaction occurs since the reactant and reacted gases are alternately flowing into and out of the pore spaces of the solid reactant where a large area for reaction exists. Reacted gases are recycled back through repeated cycles of compression and expansion until adequately reacted after which they are replaced with fresh reactant gases.

19 Claims, 6 Drawing Figures

SOLID WITH GAS REACTOR PLANT

(C.) CROSS REFERENCES TO RELATED APPLICATIONS

This application is related to my following U.S. patent applications:

1. "Cyclic Solid Gas Reactor," Ser. No. 473,566, filed Mar. 9, 1983, from which appreciable material is incorporated herein by reference now issued as U.S. Pat. No. 4,568,361 as of Feb. 4, 1986.

2. "Cyclic Char Gasifier Oxidation Process," Ser. No. 679,541, filed Dec. 7, 1984.

This application is also related to my following issued U.S. Patents:

1. "Cyclic Char Gasifier Devolatilization Process," U.S. Pat. No. 4,537,603, issued Aug. 27, 1985.

2. "Cyclic Velox Boiler," U.S. Pat. No. 4,455,837, issued June 26, 1984.

3. "Cyclic Char Gasifier," U.S. Pat. No. 4,509,957, issued Apr. 9, 1985, from which appreciable material is incorporated herein by reference.

The following patent references may be relevant to the examination of this application:

A. U.S. Pat. Nos.: 974,087, 1,586,508, 1,913,395, 1,992,323, 2,172,124, 2,225,311, 2,396,524, 2,425,850, 2,624,172, 2,632,296, 2,675,672, 2,714,670, 3,149,617, 3,370,576, 3,734,184, 3,923,011, 3,981,277, 4,004,421, 4,011,839, 4,047,901, 4,085,578, 4,204,506, 4,333,423, 4,372,256, 4,412,511, 4,480,654, 4,533,362.

B. Great Britain Pat. Nos.: 11475, 492831.

C. Canadian Pat. No.: 651973.

(D.) BACKGROUND OF THE INVENTION

1. Field of the Invention

This invention is in the field of chemical reactor machines for reacting one or more solid reactants with one or more gaseous reactants.

2. Description of the Prior Art

The description of the prior art presented in my earlier copending U.S. patent application entitled, "Cyclic Solid Gas Reactor," Ser. No. 473,566, filed Mar. 9, 1983, is incorporated herein by reference thereto. This incorporation includes from page 1, line 27 through page 7, line 22. This application has now issued as U.S. Pat. No. 4,584,970 as of Apr. 29, 1986.

(E.) SUMMARY OF THE INVENTION

A solid with gas reactor plant of this invention compresses reactant gas into the pore spaces of one or more solid reactants where reaction occurs rapidly. Subsequently, the reactant gases are expanded out of the pore spaces to become product reacted gases. The product reacted gases are recycled back through additional cycles of compression and expansion until reacted to the desired extent, after which one or more fresh reactant gases are introduced and subsequently at least one is also recycled. The separate solid reactants remain within their separate reaction chamber through as many cycles of compression and expansion as needed for the desired extent of reaction. The compressor, expander, and reaction chambers are separate and thus product reacted gas can be heated or cooled prior to being recycled. Large capacity compressors and expanders can be used to achieve a large product output from a single plant. Large reaction chambers can be used to achieve low gas flow pressure drop into and out of the solid reactant pore spaces and thus to achieve a high work efficiency.

(F.) BRIEF DESCRIPTION OF THE DRAWINGS

Figure 1:
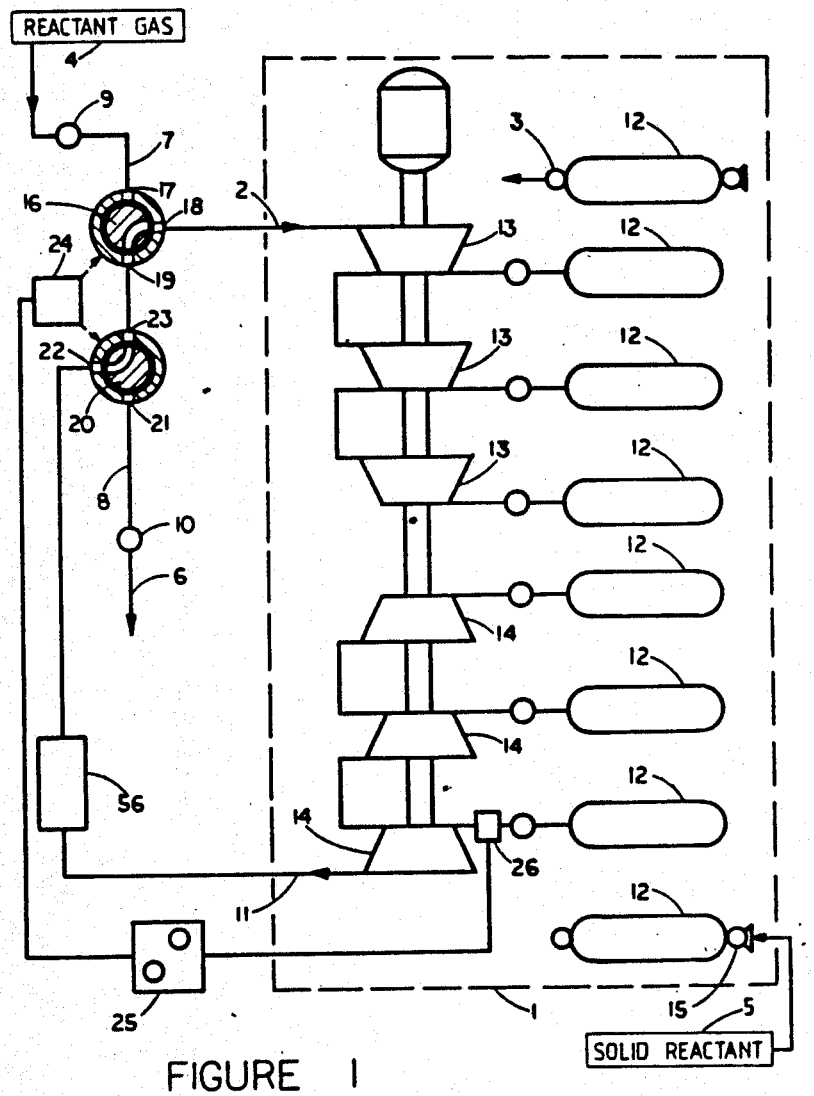
Figure 2:
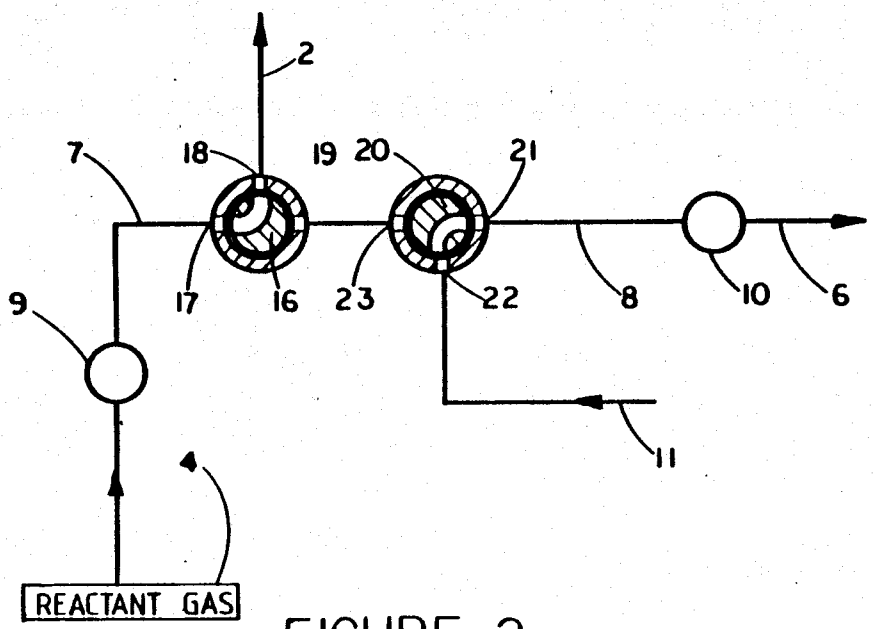

A schematic diagram of one form of solid with gas reactor of this invention is shown in FIG. 1 and FIG. 2.

Figure 3:
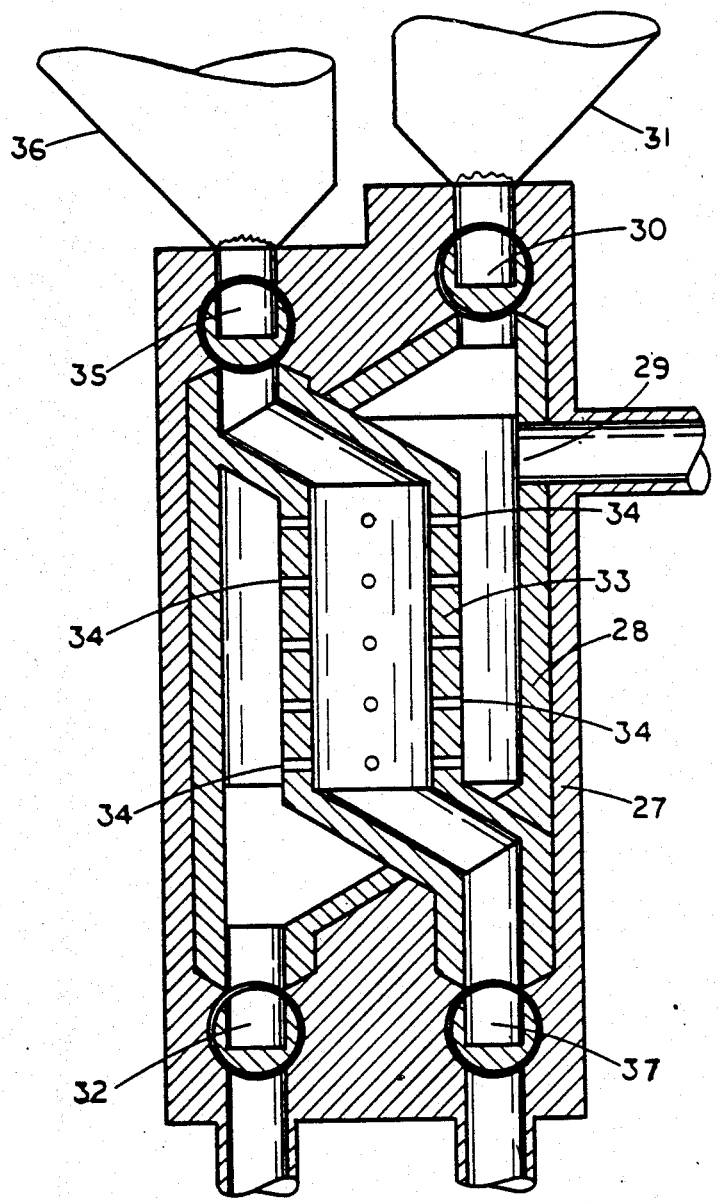

A cross section view of one form of container with two separate reaction chambers is shown in FIG. 3.

Figure 4:
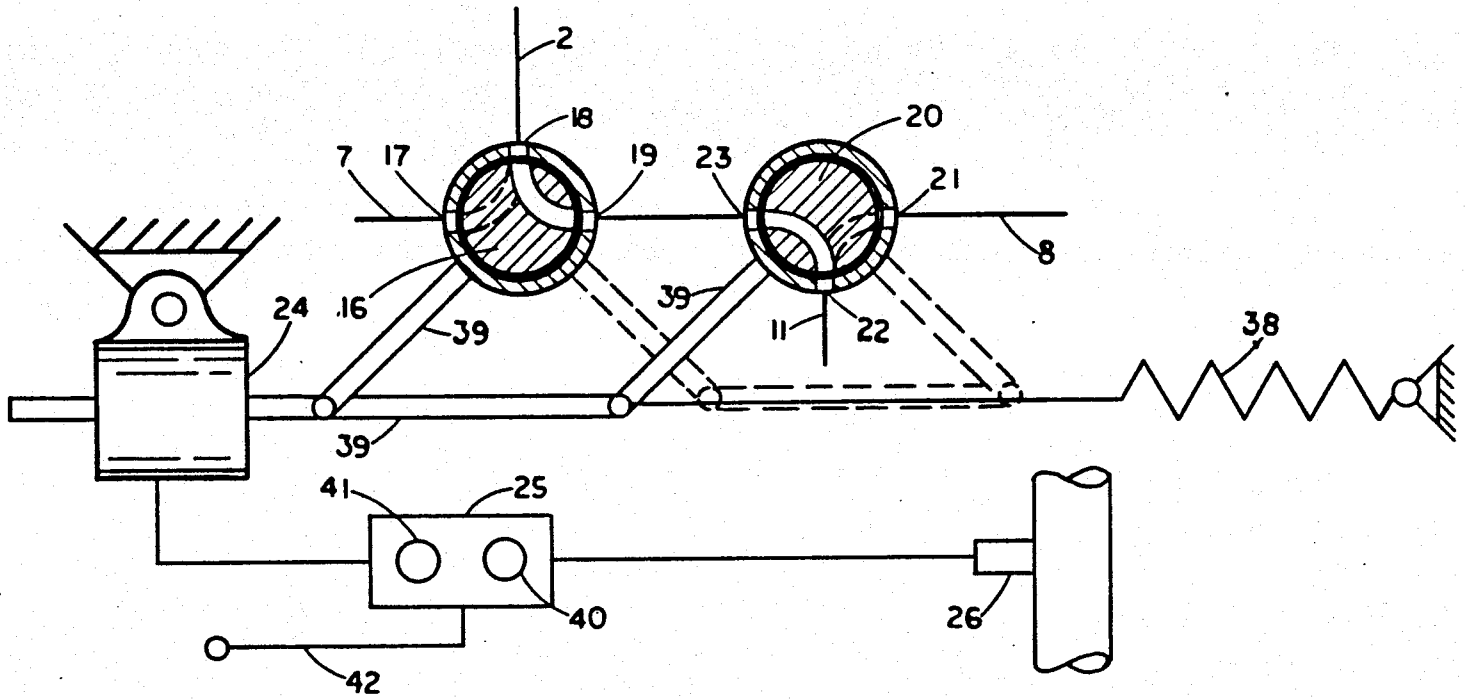

A drive means and control means for the driving of the means for recycling gas and also the means for supplying fresh reactant gas is shown in FIG. 4.

Figure 5:
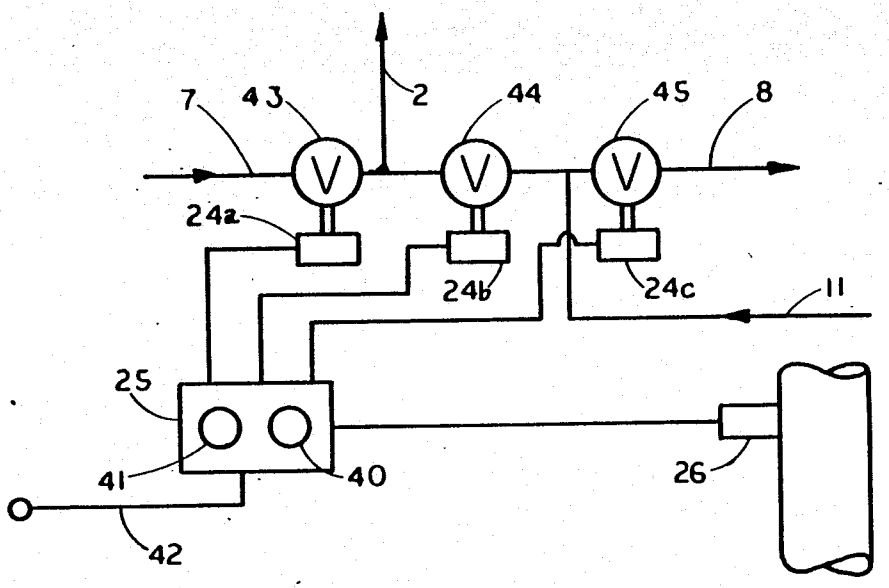

An alternative means for recycling gas and also means for supplying fresh reactant gas is shown in FIG. 5 together with a drive means and control means therefor.

Figure 6:
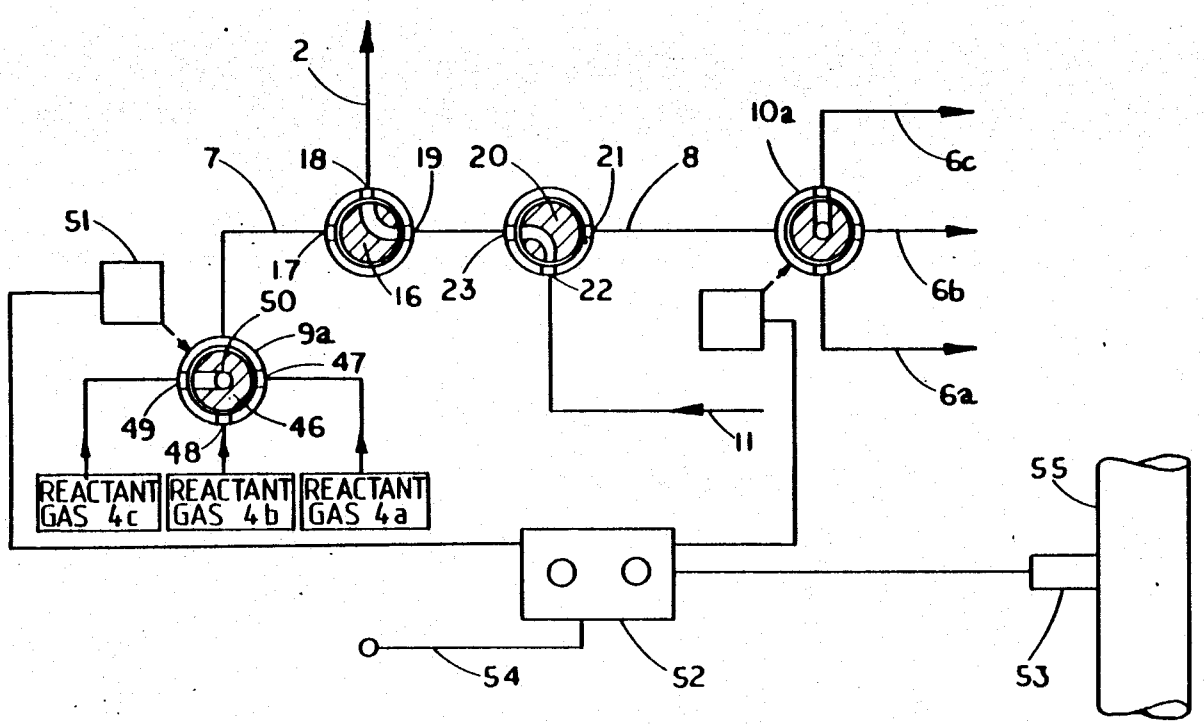

A delivery batch valve scheme and also a discharge batch valve scheme are shown schematically in FIG. 6 for reacting one or more solid reactants with two or more reactant gases and for separating the resultant product reacted gases.

(G.) DESCRIPTION OF THE PREFERRED EMBODIMENTS (g1.) Basic Elements:

A schematic diagram of one example solid with gas reactor plant of this invention is shown in FIGS. 1 and 2 and comprises the following:

A. A cyclic char gasifier apparatus, 1, as enclosed by the dashed line, includes all the elements of those forms of cyclic char gasifier plant as described in my U.S. Pat. No. 4,509,957, wherein the containers, 2, comprise pressure vessel means for containing, as described for example in claim 4 of U.S. Pat. No. 4,509,957. Other examples of suitable apparatus forms of cyclic char gasifier plants using pressure vessel containers are described in claims 5, 6, 7, 8, 15, 16, 17, 18, 19, 20, 21, 22, 27, 28, 29, 32, and 34, of U.S. Pat. No. 4,509,957. Detailed descriptions of these cyclic char gasifier apparatus and their operation are presented in my U.S. Pat. No. 4,509,957 at the following places and on the listed Figures and this material is incorporated herein by reference:

1. Column 4, line 51 through column 5, line 35;
2. Column 14, line 16 through line 52;
3. Column 15, line 7 through column 17, line 52;
4. Column 18, line 39 through column 25, line 40, together with FIGS. 1, 7, and 8;
5. Column 25, line 44 through column 36, line 65, together with FIGS. 2, 3, 4, 9, 10, 16, and 17;
6. Column 37, line 11 through column 40, line 26, together with FIGS. 11, 12, and 15;
7. Column 41, line 20 through column 46, line 38, together with FIGS. 5, 12, 13, and 14;
8. Claims 4, 5, 6, 7, 8, 15, 16, 17, 18, 19, 20, 21, 22, 27, 28, 29, 32, 34 as descriptive material.

Herein the term "reactant gas inlet," 2, is substituted for the term "reactant gas supply source" of U.S. Pat. No. 4,509,957. Also the term "means for removing non gas products, "3, is substituted herein for the term "coke removal mechanism" of U.S. Pat. No. 4,509,957. The term "cyclic char gasifier apparatus" is used herein to comprise those forms of apparatus of cyclic char gasifier plants as described in the above material incorporated herein by reference. A cyclic char gasifier apparatus comprises: a product gas collector pipe, 11; a number of containers, 12, at least equal to the sum of the number of compressor stages, 13, plus the number of expander stages, 14; each said container comprising at least one separate refuel mechanism, 15, means for adding solid reactant from the solid reactant supply source, 5, into the container; each said container further comprising at least one means for removing non gas product from the container.

B. At least one source of fresh reactant gas, 4, is used.

C. At least one source of solid reactant, 5, is used.

D. At least one product gas delivery pipe, 6, is used.

E. A fresh reactant gas connector pipe, 7, is used.

F. A product reacted gas connector pipe, 8, is used.

G. A means for connecting, 9, the fresh reactant gas connector pipe, 7, to the source of fresh reactant gas, 4, is used. When but a single source of fresh reactant gas, 4, is used, as in FIG. 1, this reactant gas means for connecting can be simply a length of pipe. When more than one source of fresh reactant gas is used, this reactant gas means for connecting, 9, becomes a delivery batch valve comprising a selector valve, as shown in FIG. 6, and as described hereinbelow.

H. A means for connecting, 10, the product reacted gas connector pipe, 8, to the product gas delivery pipe, 6, is used. When but a single product gas delivery pipe, 6, is used, as in FIG. 1, this product gas means for connecting can be simply a length of pipe. When two or more differing product gases are being produced and these are to be kept separated, this product gas means for connecting, 10, becomes a discharge batch valve comprising a selector valve, as shown in FIG. 6, and as described hereinbelow.

I. A means for recycling product reacted gas from the product gas collector pipe, 11, into the reactant gas inlet, 2, is used. As shown in the example of FIG. 1, this means for recycling comprises the selector valve, 16, with ports, 17, 18, and, 19, and the selector valve, 20, with ports, 21, 22, and, 23, with these ports connected as follows:

1. Port 17 connects to the fresh reactant gas connector pipe, 7.
2. Port 18 connects to the reactant gas inlet, 2.
3. Port 19 connects to port 23.
4. Port 21 connects to the product reacted gas connector pipe, 8.
5. Port 22 connects to the product gas collector pipe, 11.

With the selector valves, 16, and, 20, aligned for recycle as shown in FIG. 1, ports 19 and 18 are connected together, and ports 22 and 23 are connected together and in consequence product reacted gas can flow from the product gas collector pipe, 11, and be recycled back into the reactant gas inlet, 2.

J. A means for supplying fresh reactant gas from the fresh reactant gas connector pipe, 7, into the reactant gas inlet, 2, and for diverting product reacted gas from the product gas collector pipe, 11, into the product gas connector pipe, 8, is used. As shown in the example of FIGS. 1 and 2, this means for supplying and diverting comprises the same selector valves, 16, 20, and ports, 17, 18, 19, 21, 22, 23, and port connections as used for the above described means for recycling except the selector valves are turned ninety degrees counterclockwise as shown in FIG. 2, so that ports, 17, and 18, are connected together thus supplying fresh reactant gas from reactant gas connector pipe, 7, into the reactant gas inlet, 2, and so that ports, 22, and, 21, are connected together thus diverting product reacted gas from the product gas collector pipe, 11, into the product gas connector pipe, 8.

K. A means for driving, 24, and controlling, 25, 26, the means for recycling product reacted gas and also the means for supplying fresh reactant gas and for diverting product reacted gas is used. As shown in the example of FIGS. 1 and 2, the drive means, 24, drives the selector valves, 16, 20, into the recycling alignment shown in FIG. 1 and holds them thusly through a recycle sequence of cycles of compression and expansion on each container, 12. During this recycle sequence product reacted gas is being recycled for a recycle integral number of cycles on each container. Subsequently, after the recycle integral number of cycles have occurred on each container the drive means, 24, then drives the selector valves, 16, 20, into the alignment shown in FIG. 2 and holds them thusly through a fresh reactant sequence of cycles of compression and expansion on each container, 12. During this fresh reactant sequence fresh reactant gas is supplied to the reactant gas inlet, 2, and product reacted gas is diverted into the product gas connector pipe, 8, for a fresh reactant integral number of cycles on each container. The cycles counter, 26, operates upon the controller, 25, which controls the drive means, 24, to carry out the above-described recycle sequence followed by at least one fresh reactant sequence and to repeat this group of sequences continuously when the plant is operating. The selector valves, 16, 20, are driven concurrently so that either a recycle sequence is being carried out or a fresh reactant sequence is being carried out at any one time but not both types of sequences together at the same time. Commonly each recycle sequence would be followed by a fresh reactant sequence in order to replace the depleted recycled gas with fresh reactant and this replacement would occur in a single cycle on each container and hence the fresh reactant integral number of cycles would be one for this case, after which a recycle sequence would follow next. Howwever, in other cases it may be desired to replace with fresh reactant gas for several cycles on each container instead of just one cycle.

L. Within each container, 12, at least one reaction chamber is so fastened that whatever gas is compressed into the container is also compressed into these reaction chambers and also so that the gas within these reaction chambers can readily flow out of each container during expansion. Where but a single reaction chamber is used in each container this reaction chamber and the container can be the same element. In some cases, however, two or more separate reaction chambers can be used in each container and for this case all but one of these separate reaction chambers will require ports or through pores in the reaction chamber walls so that gases can flow readily into and out of each of these separate reaction chambers.

M. Each separate chamber in each container is served by but one separate refuel mechanism means for adding solid reactant, 15, thereinto. In this way a separate reaction chamber receives solid reactant from but one source of solid reactant, 5, and different separate reaction chambers in the same container receive solid reactant from different solid reactant sources.

N. The means for removing non-gas products can remove these products from all of the reaction chambers in each container together and in this case the non-gas products will be mixed together. In many cases with separate reaction chambers I will prefer to keep the non-gas products separated during and after such removal from the separate reaction chambers. For this latter case each separate reaction chamber in each container is served by but one separate non-gas removal means.

A solid with gas reactor plant of this invention, comprising the elements described above and these operated as described, can react solids with gases in the following ways:

I. A single fresh reactant gas can be reacted with a single solid reactant during compression and expansion with the fresh reactant gas recycled a sufficient number of cycles to be as fully reacted as desired and with the solid reactant retained in contact with fresh and recycled gas reactant until as fully reacted as desired.

II. A single fresh reactant gas can be reacted with two or more separate solid reactants with all these solid reactants being retained in contact with fresh and recycled gas reactant until as fully reacted as desired. If desired the non-gas products formed from the two or more separate solid reactants can be kept separated during and after removal from the separate reaction chambers.

The flow of fresh reactant gas into and the flow of product reacted gas out of such a solid with gas reactor plant is intermittent, taking place only during the fresh reactant sequence of cycles. Also, solid reactant inflow occurs intermittently only during refuel. Non-gas product outflow also usually occurs intermittently but can occur continuously, as for example when the non-gas product is a liquid.

These operating capabilities of a solid with gas reactor plant of this invention are essentially identical with those of a cyclic solid gas reactor as described in my earlier copending U.S. patent application, Ser. No. 473,566, filed Mar. 9, 1983, but the apparatus used differs appreciably, for example, in that herein compressors are separate from expanders whereas in Ser. No. 473,566 the compressor and expander are necessarily together as a single piston and cylinder unit.

The term separate is used herein and in the claims to mean not only that separate elements are mechanically separate but also that the reactants flowing through separate elements come from separate sources or are delivered into separate sinks. Hence, for example, two mechanically separate reaction chambers in one container, receiving solid reactant from the same source, are not separate as defined herein.

(g2.) Details of Elements:

An example of one container comprising two separate reaction chambers, with separate refuel means for adding solid reactant, and also with separate removal means for removing non-gas products is shown in cross section in FIG. 3 and comprises:

A. A pressure vessel container wall, 27, capable of containing the maximum gas pressure to which the container is subjected during plant operation;

B. A first separate reaction chamber, 28, with gas inlet and outlet port, 29, and supplied with solid reactant by the separate refuel means for adding, 30, from the separate solid reactant source, 31, and whose non-gas products are removed by the separate removal means for removing non-gas products, 32;

C. A second separate reaction chamber, 33, with several gas inlet and outlet ports, 34, and supplied with solid reactant by the separate refuel means for adding, 35, from the separate solid reactant source, 36, and whose non-gas products are removed by the separate removal means for removing non-gas products, 37;

D. Means for driving these separate refuel means and separate removal means are needed together with control means to control these drive means and various such means can be used as are described in the material incorporated herein by reference from my U.S. Pat. No. 4,509,957.

With this FIG. 3 type of container and separate reaction chambers the separate solid reactants are kept separated while undergoing reaction with the gas reactant and the resulting non-gas products are also kept separated while being removed from the reaction chambers. Also the gas reactant being first compressed and then expanded is in direct contact with both of the separate solid reactants in both of the separate reaction chambers.

An additional feature shown in FIG. 3 is the enclosing of the second separate reaction chamber, 33, within the first separate reaction chamber, 28, so that reactant gases reaching the second separate reaction chamber, 33, may have first reacted with solids in the first separate reaction chamber, 28. In this way sequential reaction of the gases with first one solid reactant and then another solid reactant can be achieved when desired. The iron ore reduction reaction described on page 30, line 27 through page 32, line 18 of my copending U.S. patent application, Ser. No. 473,566, "Cyclic Solid Gas Reactor," is an example of a reaction where such sequential reaction of gas with two different and separated solids is desired, and this material from Ser. No. 473,566, is incorporated herein by reference. This application Ser. No. 473,566 has now issued as U.S. Pat. No. 4,584,970 as of Apr. 29, 1986. Such enclosing of one or more reaction chambers within one or more other reaction chambers will not always be desired.

One example of a means for driving and controlling the means for recycling product reacted gas and also the means for supplying fresh reactant gas and for diverting product reacted gas is shown in FIG. 4 and comprises the following:

E. A driver, shown in FIG. 4 as a solenoid 24, with return spring, 38, acts via the linkage, 39, to drive the selector valves, 16, 20, into the gas recycling alignment, shown in solid outline in FIG. 4, when the solenoid, 24, is energized. When the solenoid, 24, is deenergized the return spring, 38, drives the selector valves, 16, 20, into the fresh reactant supplying the product gas diverting alignment, shown in dashed outline in FIG. 4.

F. A controller means, 25, counts cycles of compression and expansion, as sensed by the pressure cycles sensor, 26, mounted in one of the compressor outlets or expander inlets, and when the selected set number of cycles is reached either energizes or deenergizes the solenoid, 24, and resets itself to start counting the next following sequence of cycles of compression and expansion. For the recycle sequence of cycles the set number to be counted up to equals the recycle integral number of cycles multiplied by the number of containers in use and the solenoid, 24, is energized during this counting of the recycle sequence. For the fresh reactant sequence of cycles the set number to be counted up to equals the fresh reactant integral number multiplied by the number of containers in use and the solenoid, 24, is deenergized during this counting of the fresh reactant sequence. The controller, 25, follows each recycle sequence with at least one fresh reactant sequence and follows each last fresh reactant sequence with the next recycle sequence. The recycle set number of counts and the fresh reactant set number of counts can be adjusted in integral steps via the adjustment knobs, 40, 41. Needed power is supplied to the controller, 25, from a source, 42. Note that either a recycle sequence is underway or a fresh reactant sequence is underway but never both concurrently.

Another example of a means for recycling product reacted gas and also a means for supplying fresh reactant gas and for diverting product reacted gas is shown in FIG. 5 and comprises the following:

G. A fresh reactant valve, 43, opened and closed by a solenoid and spring driver means, 24*a*.

H. A recycle valve, 44, opened and closed by a solenoid and spring driver means, 24*b*.

I. A product gas diverter valve, 45, opened and closed by a solenoid and spring driver means, 24*c*.

J. During a recycle sequence, recycle valve, 44, is open and fresh reactant valve, 43, and also product gas diverter valve, 45, are closed.

K. During a fresh reactant sequence, recycle valve, 44, is closed and fresh reactant valve, 43, and also product gas diverter valve, 45, are open.

The means for driving and controlling this FIG. 5 type of means for recycling and means for supplying fresh reactant gas and for diverting product reacted gas comprises the solenoid and spring valve drivers, 24*a*, 24*b*, 24*c*, and the controller, 25, and cycles sensor, 26. The controller, 25, and cycles sensor, 26, can be similar to that of FIG. 4 described hereinabove.

Electrically powered and operated drive means, control means and sensor means are described above but mechanical or pneumatic or hydraulic means can be substituted in whole or part for these electrical means as is well known in the art of drive means, control means and sensor means.

(g3.) Added Elements:

To the above described basic forms of this invention several different elements can be added in order to carry out different combinations of solid to gas reactions or for product gas separation or other purposes. Among these various added elements are: delivery batch valves; discharge batch valves; and reacted gas coolers or heaters.

A delivery batch valve is a particular form of the means for connecting, 9*a*, the fresh reactant gas connector pipe, 7, to two or more different sources of fresh reactant gas, 4*a*, 4*b*, 4*c*, one source at a time, as shown for example in FIG. 6. With a delivery batch valve the solid reactant within the reaction chamber may be reacted with type one fresh reactant gas for a sequence of several cycles or for several sequences of cycles, and then be reacted with type two fresh reactant gas for another sequence of several cycles or for several sequences of cycles, and so on through several different types of fresh reactant gases, before commencing again with the type one fresh reactant gas to repeat these several groups of sequences of cycles again in the same order. Each time the several groups of sequences of cycles are repeated in the same order by action of the delivery batch valve, a delivery batch of groups of sequences of cycles is carried out. While the delivery batch valve remains connected to but one of the fresh reactant gas supply sources, a single group of sequences of cycles is being carried out. A delivery batch valve, 9*a*, thus comprises: a selector valve, 46, with a number of inlet ports, 47, 48, 49, each connected to but one of the equal number of fresh reactant gas supply sources, 4*a*, 4*b*, 4*c*, respectively, and an outlet port, 50, connected to the inlet of the fresh reactant gas connector pipe, 7; a drive means, 51, which, when initiated, drives the selector valve to disconnect from one fresh reactant gas supply source and to connect to the next fresh reactant gas supply source in an order of inlet port connections between the fresh reactant gas connector pipe, 7, and the several fresh reactant gas supply sources, 4*a*, 4*b*, 4*c*, and for repeating this order of inlet port connections; and a means for setting the number of groups of sequences of cycles in each delivery batch groups of sequences of cycles, 52, by initiating the selector valve drive means, 51, at the end of each group to drive the selector valve on to connect to the next inlet port in order and to thus commence the next group. Various types of selector valves and drive means can be used with the delivery batch valve such as: a rotary valve with several inlet ports and a single outlet port, as shown in FIG. 6, and mechanically driven to connect the outlet port to the inlet ports, one port at a time, in the desired inlet order; several solenoid actuated valves, one on each reactant gas supply source and a selector circuit to open one solenoid valve at a time in the desired inlet order; etc. Various kinds of means for setting the number of sequences in each delivered batch can be used, of which the simplest is a hand initiation of the selector valve drive means. More commonly an automatic means for setting will be preferred which counts sequences up to a set value of sequences and then initiates the selector valve drive means and also resets itself to start counting the sequences of the next group. For example, the means for setting, 52, the number of groups of sequences of cycles in each delivery batch of groups of sequences can receive as input a cycles count from the pressure cycles sensor, 53, in one of the compressor outlets or one of the expander inlets, 55, and as output act to initiate the selector valve drive means, 51, being energized from a power source, 54.

A discharge batch valve is a particular form of the means for connecting, 10*a*, the product gas connector pipe, 8, to two or more separate product gas delivery pipes, 6*a*, 6*b*, 6*c*, one delivery pipe at a time as shown for example in FIG. 6. With a discharge batch valve, the gaseous products formed within the reaction chamber can be separated into separate portions within the separate product gas delivery pipes. Use of a discharge batch valve is preferred where the product gases change composition as between different sequences of cycles, and it is desired to further utilize these different product gases for different purposes.

With a discharge batch valve, 10*a*, the gaseous products discharged from the product gas collector pipe, 11, into the product gas connector pipe, 8, during fresh reactant gas sequences may be directed into one product gas delivery means, 6*a*, for a sequence of several cycles or for several sequences of cycles, and may then be redirected into another product gas delivery means, 6*b*, for another sequence of several cycles or for several sequences of cycles, and so on through several product gas delivery means before connecting again with the delivery means, 6*a*, to repeat these several groups of sequences of cycles again in the same order. Each time the several groups of sequences of cycles are repeated in the same order by action of the discharge batch valve, a discharge batch of groups of sequences of cycles is carried out. While the discharge batch valve remains connected to but one of the product gas delivery means but a single group of sequences of cycles is being carried out. Except for the gas flow direction between ports, as described above, a discharge batch valve is similar to the delivery batch valves already described above and carries out an outlet order of connections which is repeated. Also similar is the means for setting the number of sequences in each discharge batch.

A cyclic solid gas reactor machine of this invention may comprise a delivery batch valve without a discharge batch valve, or a discharge batch valve without a delivery batch valve, or both a delivery batch valve and a discharge batch valve, depending upon the intended uses of the plant as illustrated in the following examples:

A. where the principal useful products are non-gaseous products formed by reacting solid reactants with two or more fresh gas reactants and the gas product is of no value, only a delivery batch valve would be used;

B. where principal useful products are gas products, formed by reacting solid reactants with a single fresh gas reactant, and whose composition changes during a sequence or between sequences, only a discharge batch valve would be used to separate these product gases of different composition;

C. where principal useful products are gas products, formed by reacting solid reactants with two or more different fresh gas reactants, and whose composition changes during a sequence or between sequences both a delivery batch valve and a discharge batch valve would be used.

Commonly where both a delivery batch valve a discharge batch valve are used together the product gas composition changes because the delivery batch valve has changed connection to a different fresh gas reactant supply source. In this case, it will usually be preferred to change the discharge batch valve connection at the same time that the delivery batch valve connection is changed. For this purpose, a relative timing means can be used to time the discharge batch means for setting and the delivery batch means for setting so that a batch of delivery sequences starts and ends at the same time as a batch of discharge sequences. This relative timing means can be any of various types, of which the simplest is simultaneous hand initiation of both selector valve drive means. Automatic relative timing means will usually be preferred, such as using a single common drive means to drive both the delivery selector valve and the discharge selector valve which can be initiated by a single common means for setting the number of groups of sequences in each batch.

The delivery batch valve and the discharge batch valve perform herein the same functions as are performed by the delivery group valve and the discharge group valve of my earlier filed copending U.S. patent application, "Cyclic Solid Gas Reactor," Ser. No. 473,566, filed Mar. 9, 1983, and several examles of suitable selector valves, drive means, and means for setting are described therein as listed below:

(1) Page 19, line 23 through page 26, line 6, together with FIGS. 1, 8, 9, 10, and 11;

(2) Page 39, line 28 through page 41, line 2;

(3) Page 43, line 16 through page 51, line 11, together with FIG. 17;

(4) Page 51, line 31 through page 52, line 23, together with FIG. 2.

This above listed material from Ser. No. 473,566 is incorporated herein by reference. This application Ser. No. 473,566 has now issued as U.S. Pat. No. 4,584,970 as of Apr. 29, 1986. Note that a simple crankshaft revolutions counter can be used as a cycles counter in a cyclic solid gas reactor of Ser. No. 473,566, using piston and cylinder compressor-expander means. In general, however, a shaft revolutions counter is not suitable for use as a cycles counter herein, since the compressor and expander and reaction chambers are separate from each other. Other types of cycles counters can be used such as a pressure cycles counter, 53, sensing the number of cycles of pressure change experienced at a compressor outlet or at an expander inlet, 55.

Coolers and heaters can be used as a means for changing the temperature of the product reacted gases being recycled. Any of various kinds and locations of cooling and heating means can be used. For example, when the solid to gas reaction is endothermic, recycling of the consequently colder product reacted gas can cause a drop in compression pressure and hence reaction speed. By heating the reacted gases being recycled, this pressure and reaction speed drop can be avoided. Alternatively, when the solid to gas reaction is exothermic, recycling of the consequently hotter product reacted gas can cause a decrease in gas mass flow rate and hence reaction speed. By cooling the reacted gases being recycled, this mass flow rate and reaction speed drop can be avoided. These coolers or heaters, 56, can be located in the product gas collector pipe, 11, as shown for example in FIG. 1, in which case the product reacted gas is always cooled or heated whether being recycled or being diverted into product gas delivery pipes. Alternatively, the coolers or heaters can be located between the ports, 19, and, 23, of the means for recycling, in which case the product reacted gas is cooled or heated only while being recycled.

(g4) Comparison with Cyclic Solid Gas Reactors:

The inventions described herein are capable of carrying out the same chemical reaction processes as are the cyclic solid gas reactors described in my copending U.S. patent application Ser. No. 473,566, examples of which are described at the following places therein:

(4) Page 11, line 27 through page 12, line 21;

(5) Page 30, line 4 through page 32, line 18;

(6) Page 62, line 20 through page 64, line 25;

and this material from my application Ser. No. 473,566 is incorporated herein by reference. This application Ser. No. 473,566 has now issued as U.S. Pat. No. 4,584,970 as of Apr. 29, 1986.

The solid with gas reactor plants described herein have the following beneficial advantages over the cyclic solid gas reactors of my application Ser. No. 473,566:

A. A large capacity single solid with gas reactor plant can be built since the piston diameter and stroke and speed limitations of a cyclic solid with gas reactor need not apply to the compressors and expanders used herein. Larger capacity usually results, not only in higher efficiency, but also in lower costs per unit of product.

B. A smaller loss of work output due to gas pressure loss during flow into and out of the solid reactant pores can be obtained in a solid with gas reactor than in a cyclic solid gas reactor since much slower rates of pressure rise during compression and pressure drop during expansion can be used. Hence, a higher work efficiency can be obtained with a solid with gas reactor.

C. A solid with gas reactor can utilize product reacted gas coolers and heaters during recycling, as described herein above, whereas this cannot be done with cyclic solid gas reactors where the compressor and expander are a single piston and cylinder unit.

These advantages are among the beneficial objects of the invention described herein.

The piston diameter of piston and cylinder compressor-expander units is often limited by heat transfer requirements and by resulting cyclic thermal stresses as is well known, for example, in the art of large marine diesel engines. The useable speed and stroke length are limited by acceleration stresses. The net result of these limitations is that the gas flow capacity of a piston and cylinder compressor-expander unit as used in cyclic solid gas reactors is limited. This limit can be greatly exceeded by use of other types of separate compressors and expanders particularly turbocompressors and turboexpanders. Such alternative compressors and expanders can be readily used in the solid with gas reactors of this invention and hence the gas flow capacity of a solid with gas reactor can be much larger than the gas flow capacity of a cyclic solid gas reactor. Generally, larger capacity plants yield lower capital and operating costs per unit of product output.

During compression reactant gas flows into the pore spaces of the solid reactant and during expansion reacted gas flows out of these pore spaces. A pressure loss necessarily occurs as a result of this gas flow into and out of the pore spaces and results in a reduction of net mechanical work output or an increase of net mechanical work input. High gas flow velocities and hence high pore flow pressure loss, are almost inevitable with piston and cylinder compressor-expander units since these must operate at reasonably high cycles per minute if even moderate plant capacity is to be realized. Low gas flow velocities and hence low pore flow pressure loss can be easily achieved in solid with gas reactors as described herein since compressors are separate from expanders and reaction chambers. Hence herein we can use very large reaction chambers with consequently low cycles per minute and low gas flow velocities. In this way the work efficiency of a solid with gas reactor can be greater than the work efficiency of a cyclic solid gas reactor.

Having thus described my invention what I claim is:

1. A solid with gas reactor plant comprising:

a fresh reactant gas connector pipe;

a product reacted gas connector pipe;

a number of different sources of fresh reactant gas, said number being at least one;

a number of separate sources of solid reactant, said number being at least one;

a number of separate product gas delivery pipes, said number being at least one;

means for connecting said fresh reactant gas connector pipe to said at least one source of fresh reactant gas;

means for connecting said product reacted gas connector pipe to said at least one product gas delivery pipe;

a cyclic char gasifier apparatus comprising:

a compressor means for compressing gases from a lower pressure to a higher pressure and comprising an integral number of stages, said integral number of stages being at least one, and each of said stages comprising a supply end and a delivery end;

means for driving said compressor means;

an expander means for expanding gases from a higher pressure to a lower pressure and comprising an integral number of stages, said integral number of stages being at least one, and each of said stages comprising an inlet end and a discharge end;

at least two separate containers, each of said at least two containers comprising pressure vessel means for containing any gas compressed thereinto, each of said at least two containers comprising at least one refuel end through which solid reactant can be placed inside said container, each of said at least two containers comprising at least one removal end through which non-gas products can be removed from the inside of said container;

a product gas collector pipe;

a reactant gas inlet;

wherein said number of compressor stages exceeds one and further comprises fixed open gas flow connections from the delivery end of each of said compressor stages, except one, to the supply end of one other stage of said compressor means, whereby said stages of said compressor means are connected in series so that the pressure of a particular gas mass, at delivery from each of said stages, increases as the gas mass is compressed through said series connected stages, from the supply end to the delivery end of each of said stages with a first of said stages in said series through which a gas mass first flows being both the lowest pressure stage and also that one stage whose supply end does not have a fixed open gas flow connection from the delivery end of any other stage of said compressor means, and with a last stage in said series through which a gas mass last flows being both the highest pressure stage and also the one stage whose delivery end does not have a fixed open gas flow connection to the supply end of any other of said stages of said compressor means;

fixed open gas flow connections from the supply end of the lowest pressure stage of said compressor means to said reactant gas inlet, wherein said number of expander stages exceeds one and further comprises fixed open gas flow connections from the discharge end of each of said expander stages, except one, to the inlet end of one other of said stages of said expander means, whereby said stages of said expander means are connected in series so that the pressure of a particular gas mass, at discharge from each of said stages, decreases as said gas mass is expanded through said series connected stages, from the inlet end to the discharge end of each of said stages, with a first stage in said series through which a gas mass first flows being both the highest pressure stage and also that one stage whose inlet end does not have a fixed open gas flow connection from the discharge end of any other stage of said expander means, and with a last stage in said series through which a gas mass last flows being both the lowest pressure stage and also that one stage whose discharge end does not have a fixed open gas flow connection to the inlet end of any other of said stages of said expander means;

fixed open gas flow connections from the discharge end of the lowest pressure stage of said expander means to said product gas collector pipe;

changeable gas flow connections, which are openable and closeable, from each of said at least two containers to each delivery end of each of said stage of said compressor means, and to each inlet end of each of said stages of said expander means;

wherein said at least two containers comprises a number of containers, at least equal to the sum of the number of compressor stages and the number of expander stages;

at least one refuel mechanism, said at least one refuel mechanism comprising:

means for transferring a volume of solid material from said at least one source of said reactant into said at least two containers when said refuel transfer means is connected to said refuel end of said at least two containers;

means for connecting said refuel transfer means to said refuel end of said at least two containers for a time period for refueling and for disconnecting said refuel transfer means from said refuel end of said at least two containers at the end of said refuel time period;

means for sealing said means for connecting and disconnecting and said refuel end of said at least two containers against gas leakage;

at least one means for removing non-gas products comprising:

means for transferring a volume of non-gas materials out of said at least two containers when said at least one means for removing is connected to said removal end of said at least two containers;

means for connecting said at least one means for removing to said removal end of said at least two containers for a time period for non-gas product removal and for disconnecting said at least one means for removing from said removal end of said at least two containers at the end of said non-gas product removal time period;

means for sealing said means for connecting and disconnecting and said removal end of said at least two containers against gas leakage;

means for opening and closing said changeable gas flow connections so that each of said at least two containers is opened for a time period to each delivery end of each of said stages of said compressor means, in a subsequence of time periods of open gas flow connections to compressor stages, said sub-sequence proceeding in time order of increasing compressor stage delivery pressure, and is opened for a time period to each inlet end of each of said stages stage of said expander means, in a sub-sequence of time periods of open gas flow connections to expander stages, said sub-sequence of said expander stages proceeding in time order of decreasing expander stage inlet pressure, said sub-sequence of connections to said compressor stages being followed by said sub-sequence of connections to said expander stages, and these together comprise one sequence of time periods of open gas flow connections, each of said at least two containers is opened to only one of said stages during any one time period of said sequence of time periods, said sequence of time periods of open gas flow connections to said compressor stages and to said expander stages is repeated for each of said at least two containers by said means for opening and closing, for each of said at least two containers each said one sequence of open gas flow connections to said compressor stages and to said expander stages is a single cycle of compression and expansion;

means for controlling said means for opening and closing, and said means for connecting said refuel transfer means and said means for connecting said at least one non-gas product removing means, so that said repeated sequences of time periods of open gas flow connections, and any time periods available only for refueling and for non-gas product removal, are a continuous series of time periods for any one of said at least two containers, and so that the delivery end of each of said stages of said compressor means has an open gas flow connection to at least one of said at least two containers, and the inlet end of each of said stages of said expander means has an open gas flow connection to at least one of said at least two containers, during all time periods, whenever said plant is operating;

recycle means for connecting said product gas collector pipe to said reactant gas inlet and for disconnecting said product gas collector pipe from said reactant gas inlet;

supply means for connecting said fresh reactant gas connector pipe to said reactant gas inlet and for disconnecting said fresh reactant gas connector pipe from said reactant gas inlet;

diverting means for connecting said product gas collector pipe to said product reacted gas connector pipe;

means for driving said recycle means for connecting and disconnecting and said supply means for connecting and disconnecting and said diverting means for connecting so that:

said reactant gas inlet is connected to said product gas collector pipe whenever said product reacted gas connector pipe is disconnected from said product gas collector pipe, whereby product reacted gas is recycled to said reactant gas inlet;

and so that said product reacted gas connector pipe is connected to said product gas collector pipe whenever said reactant gas inlet is connected to said fresh reactant gas connector pipe, whereby fresh reactant gas is supplied to said reactant gas inlet and product reacted gas is diverted into said product gas connector pipe;

and so that, at any one time, said reactant gas inlet is connected to one and only one of the two, said product gas collector pipe, said fresh reactant gas connector pipe;

means for controlling said means for driving said recycle means, said supply means, and said diverting means, so that:

said reactant gas inlet is connected to said product gas collector pipe during a recycle sequence of cycles of compression and expansion on each of said at least two containers, said recycle sequence comprising a recycle integral number of cycles, said recycle integral number being at least one;

said reactant gas inlet is connected to said fresh reactant gas connector pipe during a fresh reactant sequence of cycles of compression and expansion on each of said at least two containers, said fresh reactant sequence comprising a fresh reactant integral number of cycles, said fresh reactant integral number being at least one;

each said recycle sequence is followed by at least one said fresh reactant sequence, and the last of said following fresh reactant sequence is followed by a recycle sequence, and each said recycle sequence followed by at least one fresh reactant sequence comprises a group of sequences, and said groups of sequences follow one another continuously whenever said plant is running;

whenever a recycle sequence is underway a fresh reactant sequence is not underway and whenever a fresh reactant sequence is underway a recycle sequence is not underway;

plural reaction chambers, the number of said plural reaction chambers being equal to the number of said at least two containers multiplied by a chamber integral number, and each of said plural reaction chambers comprising means for containing solid reactants and non-gas products so that gas can readily flow into said reaction chambers during compression and gas can readily flow out of said reaction chambers during expansion, and each of said plural reaction chambers further comprising a refuel end through which solid reactant can be placed inside said reaction chambers, and each of said plural reaction chambers further comprising a removal end through which non-gas products can be removed from the inside of said reaction chambers, and said chamber integral number being at least one;

means for fastening said plural reaction chambers separately inside said at least two containers so that:

each of said at least two containers contains and encloses a chamber integral number of said plural reaction chambers;

each of said plural reaction chambers refuel end connects to but one refuel end of its enclosing container;

each of said plural reaction chambers removal end connects to but one removal end of its enclosing container.

2. A solid with gas reactor plant as described in claim 20 wherein:

said number of separate solid reactant supply sources is at least two;

said chamber integral number equals the number of said separate solid reactant supply sources;

said at least one refuel mechanism comprises a number of separate refuel mechanisms at least equal to said number of said separate solid reactant supply sources and each of said separate refuel mechanisms transfers solid reactant from but one of said separate solid reactant supply sources into only one of said plural reaction chambers of each of said at least two containers.

3. A solid with gas reactor plant as described in claim 2 wherein at least one of said plural reaction chambers is enclosed inside another one of said plural reaction chambers in each of said at least two containers.

4. A solid with gas reactor plant as described in claim 3:

wherein said number of different sources of fresh reactant gas is at least two;

and further wherein said means for connecting said fresh reactant gas connector pipe to said at least two sources of fresh reactant gas comprises:

a delivery batch valve comprising; a delivery selector valve with one outlet port and a number of inlet ports equal to the number of said different fresh reactant gas supply sources, a drive means for driving said delivery selector valve to connect said outlet port to said inlet ports, when initiated, one inlet port at a time in an inlet order of connections to inlet ports and for repeating said inlet order of connections, said delivery selector valve outlet port connecting to said fresh reactant gas connector pipe, each of said inlet ports of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated.

5. A solid with gas reactor plant as described in claim 3:

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated.

6. A solid with gas reactor plant as described in claim 3:

wherein said number of different sources of fresh reactant gas is at least two;

and further wherein said means for connecting said fresh reactant gas connector pipe to said at least said source of fresh reactant gas comprises:

a delivery batch valve comprising; a delivery selector valve with one outlet port and a number of inlet ports equal to the number of said different fresh reactant gas supply sources, a drive means for driving said delivery selector valve to connect said outlet port to said inet ports, when initiated, one inlet port at a time in an inlet order of connections to inlet ports and for repeating said inlet order of connections, said delivery selector valve outlet port connecting to said fresh reactant gas connector pipe, each said inlet port of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated;

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated;

and further comprising means for timing said drive means for driving said delivery selector valve and said drive means for driving said discharge selector valve so that each delivery batch of groups of sequences starts concurrently with the start of one discharge batch of groups of sequences and also ends concurrently with the ending of that same one discharge batch of groups of sequences.

7. A solid with gas reactor plant as described in claim 3, and further comprising means for changing the temperature of the recycled product reacted gas prior to recompression, and means for connecting said means for changing the temperature into any portion of said product gas collector pipe and said recycle means for connecting and disconnecting said product gas collector pipe and said reactant gas inlet through which product reacted gas flows during said recycle sequence of cycles.

8. A solid with gas reactor plant as described in claim 3, and further comprising:

means for changing the number of cycles in said fresh reactant integral number of cycles;

means for changing the number of cycles in said recycle integral number of cycles.

9. A solid with gas reactor plant as described in claim 2:

wherein said number of different sources of fresh reactant gas is at least two;

and further wherein said means for connecting said fresh reactant gas connector pipe to said at least two sources of fresh reactant gas comprises;

a delivery batch valve comprising; a delivery selector valve with one outlet port and a number of inlet ports equal to the number of said different fresh reactant gas supply sources, a drive means for driving said delivery selector valve to connect said outlet port to said inlet ports, when initiated, one inlet port at a time in an inlet order of connections to inlet ports and for repeating said inlet order of connections, said delivery selector valve outlet port connecting to said fresh reactant gas connector pipe, each of said inlet ports of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated.

10. A solid with gas reactor plant as described in claim 2:

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated.

11. A solid with gas reactant plant as described in claim 2:

wherein said number of different sources of fresh reactant gas is at least two;

and further wherein said means for connecting said fresh reactant gas connector pipe to said at least two source of fresh reactant gas comprises:

a delivery batch valve comprising; a delivery selector valve with one outlet port and a number of inlet ports equal to the number of said different fresh reactant gas supply sources, a drive means for driving said delivery selector valve to connect said outlet port to said inlet ports, when initiated, one inlet port at a time in an inlet order of connections to inlet ports and for repeating said inlet order of connections, said delivery selector valve outlet port connection to said fresh reactant gas connector pipe, each said inlet port of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated;

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated;

and further comprising means for timing said drive means for driving said delivery selector valve and said drive means for driving said discharge selector valve so that each delivery batch of groups of sequences starts concurrently with the start of one discharge batch of groups of sequences and also ends concurrently with the ending of that same one discharge batch of groups of sequences.

12. A solid with gas reactor plant as described in claim 2 wherein each of said at least two containers of said cyclic char gasifier apparatus further comprises a number of separate non-gas product removal means at least equal to the number of said separate reaction chambers, in each of said at least two containers;

and further wherein each said separate removal means for removing removes non-gas product so that such removal occurs from the same one of said plural reaction chambers of each of said at least two containers.

13. A solid with gas reactor plant as described in claim 2, and further comprising means for changing the temperature of the recycled product reacted gas prior to recompression, and means for connecting said means for changing the temperature into any portion of said product gas collector pipe and said recycle means for connecting and disconnecting said product gas collector pipe and said reactant gas inlet through which product reacted gas flows during said recycle sequence of cycles.

14. A solid with gas reactor plant as described in claim 2, and further comprising:

means for changing the number of cycles in said fresh reactant integral number of cycles;

means for changing the number of cycles in said recycle integral number of cycles.

15. A solid with gas reactor plant as described in claim 1:

wherein said number of different sources of fresh reactant gas is at least two;

and further wherein said means for connecting said fresh reactant gas connector pipe to said at least two sources of fresh reactant gas comprises:

a delivery batch valve comprising; a delivery selector valve with one outlet port and a number of inlet ports equal to the number of said different fresh reactant gas supply sources, a drive means for driving said delivery selector valve to connect said outlet port to said inlet ports, when initiated, one inlet port at a time in an inlet order of connections to inlet ports and for repeating said inlet order of connections, said delivery selector valve outlet port connecting to said fresh reactant gas connector pipe, each of said inlet ports of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated.

16. A solid with gas reactor plant as described in claim 1:

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated.

17. A solid with gas reactor plant as described in claim 1:

wherein said number of different sources of fresh reactant gas is at least two;

and further wherein said means for connecting said fresh reactant gas connector pipe to said at least two source of fresh reactant gas comprises:

a delivery batch valve comprising; a delivery selector valve with one outlet port and a number of inlet ports equal to the number of said different fresh reactant gas supply sources, a drive means for driving said delivery selector valve to connect said outlet port to said inlet ports, when initiated, one inlet port at a time in an inlet order of connections to inlet ports and for repeating said inlet order of connections, said delivery selector valve outlet port connecting to said fresh reactant gas connector pipe, each said inlet port of said delivery selector valve connecting to but one of said at least two fresh reactant gas supply sources;

means for setting the number of groups of sequences in each delivery batch of groups of sequences by initiating said drive means of said delivery group valve to drive said delivery selector valve to connect to the next inlet port in said order of inlet ports, whereby a delivery batch of groups of sequences is carried out each time said inlet order of connections is repeated;

wherein said number of separate product gas delivery pipes is at least two;

and further wherein said means for connecting said product reacted gas connector pipe to said at least two product gas delivery pipes comprises:

a discharge batch valve comprising; a discharge selector valve with one inlet port and a number of outlet ports equal to the number of said product gas delivery pipes, a drive means for driving said discharge selector valve to connect said inlet port to said outlet ports, when initiated, one outlet port at a time in an outlet order of connections to outlet ports and for repeating said outlet order of connections, said discharge selector valve inlet port connecting to said product gas connector pipe, each said outlet port of said discharge selector valve connecting to but one of said at least two product gas delivery pipes;

means for setting the number of groups of sequences in each discharge batch of groups of sequences by initiating said drive means of said discharge group valve to drive said discharge selector valve to connect to the next outlet port in said order of outlet ports, whereby a discharge batch of groups of sequences is carried out each time said outlet order of connections is repeated;

and further comprising means for timing said drive means for driving said delivery selector valve and said drive means for driving said discharge selector valve so that each delivery batch of groups of sequences starts concurrently with the start of one discharge batch of groups of sequences and also ends concurrently with the ending of that same one discharge batch of groups of sequences.

18. A solid with gas reactor plant as described in claim 1, and further comprising means for changing the temperature of the recycled product reacted gas prior to recompression, and means for connecting said means for changing the temperature into any portion of said product gas collector pipe and said recycle means for connecting and disconnecting said product gas collector pipe and said reactant gas inlet through which product reacted gas flows during said recycle sequence of cycles.

19. A solid with gas reactor plant as described in claim 1 and further comprising:

means for changing the number of cycles in said fresh reactant integral number of cycles;

means for changing the number of cycles in said recycle integral number of cycles.

* * * * *

UNITED STATES PATENT AND TRADEMARK OFFICE

CERTIFICATE OF CORRECTION

PATENT NO. : 4,692,171

DATED : 8 Sept. 1987

INVENTOR(S) : Joseph C. Firey

It is certified that error appears in the above-identified patent and that said Letters Patent is hereby corrected as shown below:

Col. 1, line 12: delete, "4,568,361 as of Feb. 4 1986," and insert, -- 4,584,970 as of 29 April 1986.--, in its place;

Col. 1, line 14: add on, --now issued as U.S. Pat. No. 4,568,361 as of 4 Feb. 1986.--;

Col. 4, line 57: insert, -- reaction--, between -separate- and -chamber-;

Col. 6, line 48: delete the last, "the," and replace with, --and--;

Col. 8, line 13: insert, --of--, between -batch- and -groups-;

Col. 9, line 32: insert, --and--, between -valve- and -a-;

Col. 15, line 48: change, "20", to --1--;

Signed and Sealed this

Twelfth Day of January, 1988

*Attest:*

DONALD J. QUIGG

*Attesting Officer*

*Commissioner of Patents and Trademarks*